US005581848A

United States Patent [19]

Egerer

[11] Patent Number: 5,581,848

[45] Date of Patent: Dec. 10, 1996

[54] SAW TOOTH FITTINGS

[75] Inventor: Josef Egerer, Schwabach, Germany

[73] Assignee: Staedtler & Uhl, Schwabach, Germany

[21] Appl. No.: 531,190

[22] Filed: Sep. 19, 1995

[30] Foreign Application Priority Data

Oct. 12, 1994 [DE] Germany ..... 44 36 378.8

[51] Int. Cl.[6] ..... D01G 15/88; D01G 19/10

[52] U.S. Cl. ..... 19/114; 19/113

[58] Field of Search ..... 19/113, 114

[56] References Cited

U.S. PATENT DOCUMENTS

| | | | |
|---|---|---|---|
| 2,937,413 | 5/1960 | Hollingsworth | 19/114 |
| 3,175,251 | 3/1965 | Reiterer | 19/114 |
| 4,651,387 | 3/1987 | Giuliani | 19/113 |
| 4,928,356 | 5/1990 | Egerer | 19/129 R |
| 4,964,195 | 10/1990 | Hollingsworth | 19/114 |
| 5,423,176 | 6/1995 | Stahlecker et al. | 19/114 X |

FOREIGN PATENT DOCUMENTS

| | | | |
|---|---|---|---|
| 1322217 | 2/1963 | France | 19/114 |
| 8507744 | 10/1928 | Germany | 19/114 |
| 1306625 | 12/1989 | Japan | 19/114 |
| 1493696 | 7/1989 | U.S.S.R. | 19/113 |
| 566 | 1/1910 | United Kingdom | 19/114 |

*Primary Examiner*—John J. Calvert
*Attorney, Agent, or Firm*—Browdy and Neimark

[57] ABSTRACT

The invention is directed to saw tooth fittings for preparatory textile machines including combing machines for wool or cotton wool and carding machines. The saw tooth fittings can be strips or saw tooth elements having a tooth or a plurality teeth including a first tip at a free end of either the tooth or each of the plurality of teeth. The tooth or each of the plurality of teeth have a forwarding combing edge which is concavely curved at least from a foot portion to a second tip of either the tooth or each of the plurality of teeth. The second tip is located between the first tip and the foot portion. The second tip extends forwardly from the combing front edge in the direction of combing thereby improving the combing effect.

4 Claims, 1 Drawing Sheet

SAW TOOTH FITTINGS

BACKGROUND OF THE INVENTION

1. Field of the Invention

The invention relates to saw tooth fittings for preparatory textile machines, for instance combing machines for wool or cotton wool, carding machines or the like, comprising saw tooth elements or strips, respectively, with a tooth or a plurality of teeth which, seen in the direction of combing, have a forward combing front edge of an extension concavely curved at least in sections from the foot portion of each tooth to the tip of each tooth.

2. Background Art

Conventionally, saw tooth fittings of the generic type are stamped elements comprising a foot portion and, above the latter, a plurality of teeth, these stamped elements being combined to form bars of positive fit and inserted in textile machines, for instance on the circular comb of a combing machine. It is also known to apply saw tooth wires rotatingly in circular combs.

As for the tooth configuration, attempts have been made to achieve a design in which the sliver to be combed is guided as uniformly as possible into the region between the teeth so as to ensure a good combing effect.

Depending of the specific combing job and the ideas of the individual users, shapes varying in detail are known for the teeth as such, but also for their free height above the foot portion, for their thickness transversely to the combing direction and for their relative distance from adjacent teeth located upstream or downstream of them in the combing direction or, respectively, beside them transversely to the combing direction.

SUMMARY OF THE INVENTION

Based on this general concept, it is the object of the invention to create a tooth configuration which offers a clearly improved combing effect as compared to conventional saw tooth fittings.

In accordance with the invention, this object is attained in that from the combing front edge of the at least one tooth, at least one tip extends forwardly seen in the direction of combing. This helps achieve an elongation of the combing front edge without the total height of the tooth or the projection of the tip of the tooth having to be prolonged.

This embodiment according to the invention helps overcome a prejudice among experts, namely that the actively combing front edge has to be as straight as possible or steadily concave for a fairly uniform distribution of the fibers passing through the combing teeth to be ensured along the latter's effective combing height.

Surprisingly, the invention has shown that not only the guidance of the sliver is improved due to the embodiment according to the invention, but that a clearly ameliorated combing effect is achieved, which is evidently noticeable from the fact that proceeding from a comparable basic configuration, the outfit according to the invention takes the same period of combing time to remove a considerably higher amount of flaws. There is no risk of the saw tooth fittings being clogged by impurities, because depending on the field of application, cleaning of the outfit can be effected either by brushing or by compressed air, which is a cleaning method disclosed by U.S. patent 4,928,356.

In keeping with a preferred embodiment, in which the saw tooth outfit is a stamped element having a plurality of tips, or a stamped wire, it is provided that the at least one tip is disposed approximately centrally between the foot and the tip portion of each saw tooth and extends in the combing direction. In this embodiment, the tip is defined by two sickle-shaped bights on either side and passes through the sliver approximately in parallel to the combing direction.

In this case, it is advantageously provided that above and below the single tip, the actively combing front edge of each saw tooth is concavely curved.

In another advantageous embodiment, the stamped element has a needle-type design, consequently having only a single tooth.

In this embodiment, provision can be made for the at least one additional tip to be provided in the vicinity of the upper end of the tooth or of the needle-type configuration, extending approximately in the direction of the tip of the tooth. Such stamped elements can for instance be lined up one beside the other, combining as a sort of a needle bar.

Further details of the invention will become apparent from the ensuing description of a preferred exemplary embodiment, taken in conjunction with the drawing.

DESCRIPTION OF THE PREFERRED EMBODIMENT

Figure 1:
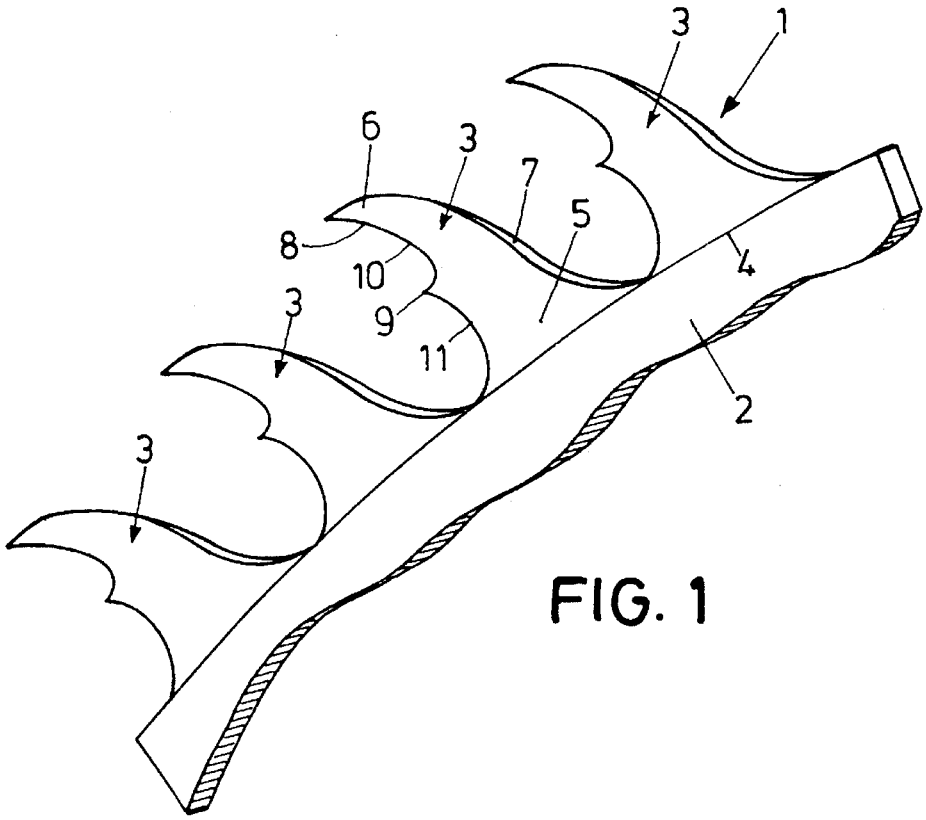
FIG. 1 is a perspective view of a first embodiment of a saw tooth outfit according to the invention in the form of a stamped element.

FIG. 1 illustrates a stamped saw tooth element 1 having a foot element 2 broken off and four teeth 3, which comprise a foot portion 5 adjoining the foot element 2 via a step 4, and a tip portion 6. The back 7 of each tooth is about S-shaped.

A front edge 8 extends in front seen in the direction of combing, a tip 9 extending in the direction of combing being provided there, above and below of which concave, sickle-shaped bights 10, 11 are formed.

Seen in cross-section, the front edge 8 has a wedge-type shape, i.e. it is pointed.

Figure 2:
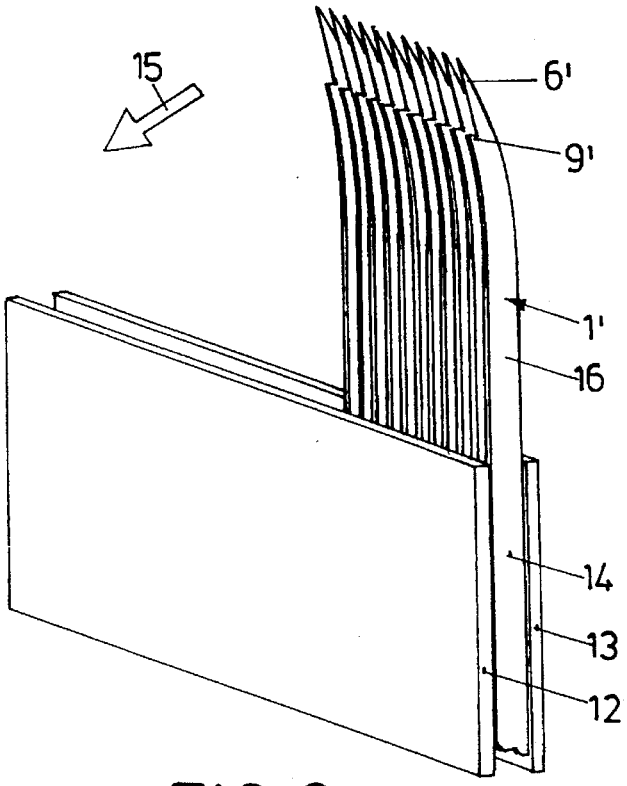
FIG. 2 is a perspective view of a second embodiment of a configuration as a needle bar.

In the embodiment according to FIG. 2, the individual stamped elements 1' are elongate, having the shape of needles, and are lined up one beside the other, sheet covers 12, 13 that are disposed on either side of their foot portion 14 serving to hold them together. Subsequent to a substantially linear, freely projecting portion 16, the stamped elements 1' are slightly concavely curved seen in the direction of combing (arrow 15). Below the tip portion 6' of the teeth, a second tip 9' is provided, likewise extending in the direction of the tip 6' so that there is an acute angle between this second tip 9' and each tip 6' of a tooth.

What is claimed is:

1. Saw tooth fittings for preparatory textile machines including combing machines for wool or cotton wool and carding machines, said saw tooth fittings comprising strips or saw tooth elements respectively, with a tooth or a plurality teeth having a first tip at a free end of either the tooth or each of the plurality of teeth, the tooth or each of the plurality of teeth having a forwarding combing edge which is concavely curved at least from a foot portion to a second tip of either the tooth or each of the plurality of teeth, the second tip located between the first tip and the foot portion, wherein the second tip extends forwardly from the combing front edge in the direction of combing thereby improving the combing effect.

2. Saw tooth fittings according to claim 1, wherein the second tip (9) is disposed approximately centrally between the foot portion (5) and the first tip of the tooth (3) and extends in the direction of combing.

3. Saw tooth fittings according to claim 2, wherein above and below the second tip (9), the combing front edge (8) of the tooth (3) is concavely curved.

4. Saw tooth fittings according to claim 1, wherein the second tip (9') is formed in the vicinity of the upper end of the tooth (3'), extending approximately in the direction of the first tip (6') of the tooth.

* * * * *